United States Patent [19]

Lisec

[11] Patent Number: 4,949,666

[45] Date of Patent: Aug. 21, 1990

[54] APPARATUS FOR THE HANDLING OF SPACER FRAMES

[76] Inventor: Peter Lisec, Bahnhofstrasse 34, A-3363 Amstetten-Hausmening, Austria

[21] Appl. No.: 283,558

[22] Filed: Dec. 12, 1988

[30] Foreign Application Priority Data

Mar. 14, 1988 [AT] Austria ..... 691/88

[51] Int. Cl.[5] ..... B05C 9/04; B05C 13/02

[52] U.S. Cl. ..... 118/110; 118/668; 118/313; 118/324

[58] Field of Search ..... 118/313, 315, 316, 320, 118/324, 100, 107, 110, 668

[56] References Cited

U.S. PATENT DOCUMENTS

| | | | |
|---|---|---|---|
| 4,458,626 | 7/1984 | Dessilani | 118/315 |
| 4,539,069 | 9/1985 | Fishman et al. | 118/316 |
| 4,711,692 | 12/1987 | Lisec | 118/100 |

FOREIGN PATENT DOCUMENTS

| | | |
|---|---|---|
| 315404 | 5/1974 | Austria . |
| 356832 | 5/1980 | Austria . |
| 365550 | 1/1982 | Austria . |
| 0255476 | 2/1988 | European Pat. Off. . |
| 2803132 | 1/1980 | Fed. Rep. of Germany . |
| 2903649 | 3/1980 | Fed. Rep. of Germany . |
| 3223881 | 9/1985 | Fed. Rep. of Germany . |
| 1418565 | 12/1975 | United Kingdom . |
| 2016960 | 9/1979 | United Kingdom . |

*Primary Examiner*—Willard Hoag

*Attorney, Agent, or Firm*—Young & Thompson

[57] ABSTRACT

In an apparatus for the coating of spacer frames for insulating glass, exhibiting corners bent in one piece, with adhesive and, respectively, sealing compound, the relative position between the connecting line of the orifices of the nozzles, on the one hand, and the axis, about which the turning device is pivotable, on the other hand, can be varied. This variability is achieved either by arranging the pivotal support of the turning device to be movable laterally and vertically (upwards and downwards) in the frame of the apparatus, or by disposing the component carrying the nozzles in the frame of the apparatus to be vertically movable (upwards and downwards) and the pivotal support of the turning device to be movable laterally. In this way, the objective is attained that the nozzles remain aligned, even during turning of the spacer frames, in opposition to the lateral faces of the spacer frames.

10 Claims, 3 Drawing Sheets

APPARATUS FOR THE HANDLING OF SPACER FRAMES

The invention relates to an apparatus for coating spacer frames for insulating glass with adhesive or sealing compound, comprising two nozzles arranged on both sides of conveying means for the frames.

Devices for the coating of spacer frames for insulating glass with adhesives or sealing compounds are conventional. In addition to devices wherein the spacer frames must be held manually while they are moved through between the coating nozzles by conveyor belts (Austrian Patent Nos. 315,404 and 365,550), devices equipped with turning mechanisms for the spacer frames are likewise known (Austrian Patent No. 356,832 and German Patent No. 2,803,132).

These conventional devices are suitable for coating spacer frames composed of profiled strips and corner angles. It is known from Austrian Patent No. 356,832 to adjust the nozzles with the purpose of adaptation of the position of the nozzle orifices to various spacer profiles (varying distance of the nozzle orifices from the horizontal conveyor belt on which the spacer frames rest while being guided during the coating process). In this arrangement, according to Austrian Patent No. 356,832, the turning mechanism is likewise moved along in every case so that the axis of this mechanism is constantly disposed substantially in the connecting line between the two nozzle orifices. Thus, in Austrian Patent No. 356,832, the relative position of the connecting line between the orifices of the nozzles with respect to the axis about which the turning mechanism is swingable remains constant.

However, spacer frames having frame corners bent of one piece are likewise known (German Patent No. 3,223,881). The known devices, when used for the coating of such spacer frames, present drawbacks since the especially critical corner zone cannot be coated with adhesive or sealing compound by means of these devices, or only to an inadequate extent.

The invention is based on the object of providing an apparatus of the type discussed hereinabove making it possible to also coat spacer frames having bent corners.

According to the invention, this has been accomplished by making the vertical relative distance between the connecting line, running between the nozzle orifices, and the axis, about which the turning device can be swung, to be variable.

Thanks to the structure of the coating device in accordance with this invention, the nozzles can follow the route of the profiled strip from which the spacer frame is made also in the bending zone, i.e. in the region of the corners of the spacer frame, and they can do this even during the turning process proper. Therefore, it is possible to coat spacer frames even in the corner zone continuously with adhesive and/or sealing compound (e.g. butyl rubber).

Additional details and features of the invention can be derived from the dependent claims and will be described in greater depth with reference to the embodiment illustrated in the drawings wherein.

The invention will be described below with reference to a coating apparatus known in its basic structure from Austrian Patent No. 356,832. In the conventional device, the turning means is adjustable in its level together with the nozzles, but the vertical relative distance between the swivel axis of the turning device and the nozzles cannot be changed.

Figure 1:
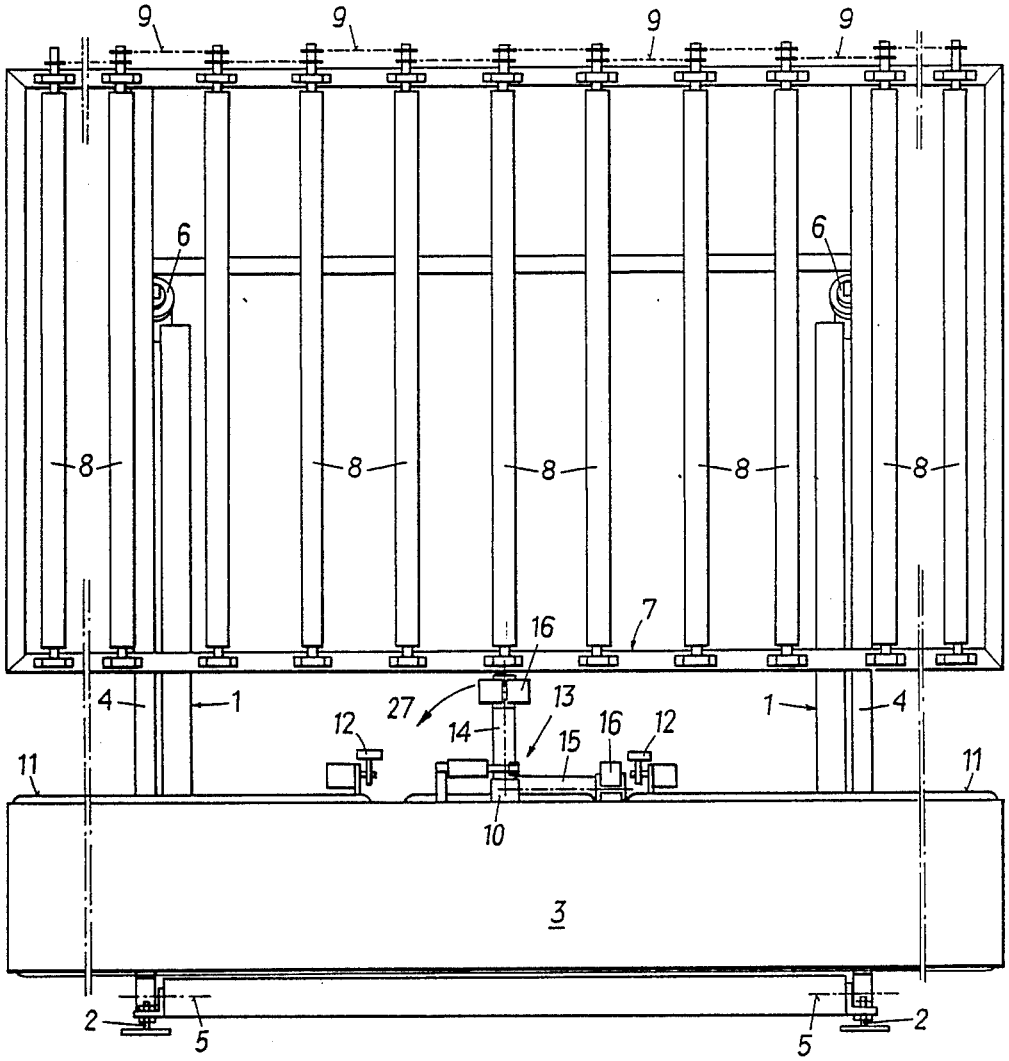
FIG. 1 shows an apparatus for coating spacer frames in a frontal view.
Figure 2:
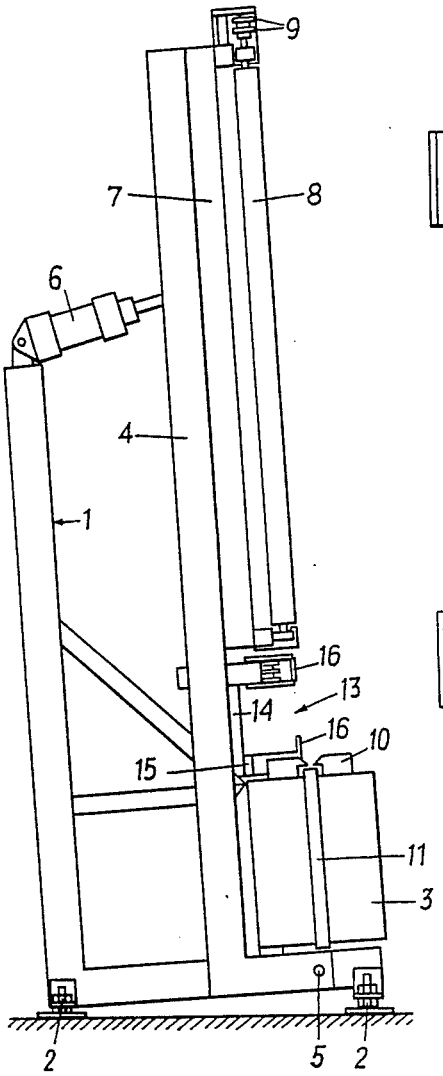
FIG. 2 shows the apparatus of FIG. 1 in a lateral view.

The apparatus illustrated in FIGS. 1 and 2 comprises a frame 1 of substantially L-shaped configuration in lateral view, this frame being supported on the ground by way of vertically adjustable feet 2 so that it is somewhat rearwardly inclined at the top (compare FIG. 2). A housing 3 and a support 4 pivotable about a lower horizontal transverse axis 5 with the aid of a piston cylinder unit with respect to the base frame are attached to the base frame 1. A frame 7 is mounted to the support 4; this frame carries several supporting rolls 8, the axes of which extend, in the basic position shown in FIG. 2, in parallel to the long segment of the base frame 1, i.e. slightly rearwardly inclined (about 5°). The supporting rolls 8 are driven via drive chains by a drive mechanism, not shown in detail, with adjustable speed.

The housing 3 accommodates a storage cylinder for adhesive and/or sealing compound with which the spacer frames for insulating glass are coated, as well as the hydraulic and/or pneumatic presses for conveying the sealing compound to nozzles 10 arranged at the topside of housing 3. The housing furthermore includes a heater whereby the sealing compound can be heated to the required processing temperature.

The nozzles 10 are arranged on both sides of conveying means for the spacer frames constituted by an endless conveyor belt 11. The drive motor for the conveyor belt 11 is likewise arranged within the housing 3.

The housing 3 furthermore carries two or more pivotable contact pressure rollers 12 which urge the section of the spacer frame guided through between the nozzles 10 against the conveyor belt 11.

Additionally, a stop (not shown in the drawing) that can be pushed forwards and backwards transversely to the conveying route is provided at the housing 3. This stop, in its first, advanced position, holds back the spacer frames transported through the apparatus, with the conveyor belt 11 continuing its movement, whenever a corner of a spacer frame is at that time between the nozzles 10.

Furthermore, a two-armed gripper 13 of a turning device is provided in the zone of the nozzles 10, this gripper being swingable about an axis passing through the outlet orifices of the nozzles 10. This gripper 13 just as the nozzles 10 is equipped with a level adjustment which also serves for adaptation to varying sizes of spacer profiles.

The gripper 13 has arms 14 and 15, each of which carries at least one clamp 16. The clamps 16, in the basic position of the gripper 13 shown in FIG. 1, exhibit an upwardly extending arm 14. The latter is intended for seizing an upwardly projecting frame section whereas the clamp 16 on the arm 15 can seize the frame section resting on the conveyor belt 11.

As can be seen from FIG. 1, the conveyor belt 11 is deflected on both sides of the nozzles 10 in the downward direction in order to provide room for the clamps 16 of the gripper that is pivotable by 90° in the direction of arrow 27 in FIG. 1. The conveyor belt 11 can also consist of several segments.

the gripper 13 can be pivoted, for example, with the aid of a pneumatically operated pressure medium motor whereby the pivoting speed can be varied. It is thereby possible to pivot relatively large spacer frames more slowly than smaller ones so that damage to larger spacer frames is avoided.

Figure 3:
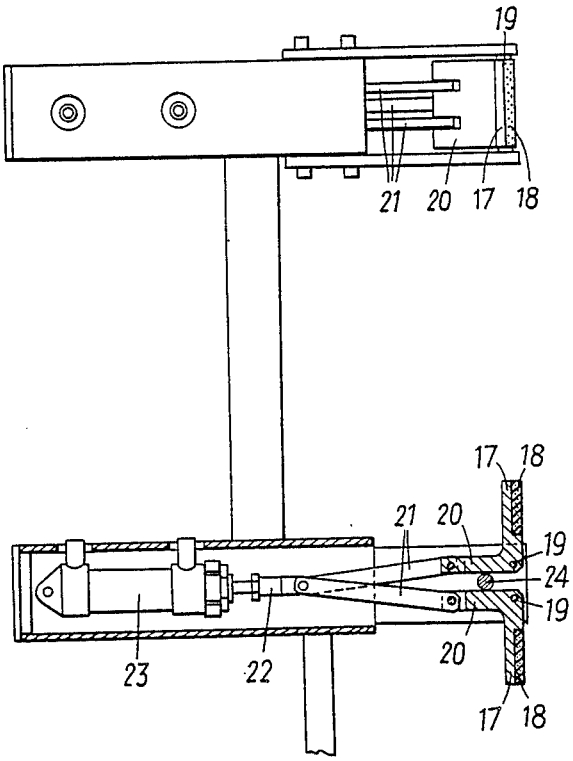
FIG. 3 shows, partially in section, a lateral view of a gripper of the turning device.

As can be seen from FIG. 3, in particular, the clamps consist of respectively two clamping jaws 17 carrying rubber liners 18. The clamping jaws 17 can be swung about axes 19 arranged at mutual spacings. In order to operate the clamping jaws 17, the latter exhibit legs 20 oriented perpendicularly thereto, these legs being articulated via guide arms 21 to the piston rod 22 of a pressure medium motor 23. An abutment 24 is provided between the legs 20, determining the open position of the clamp 16. By activation of the pressure medium motor 23, the clamping jaws 17 are swung toward each other and enter into contact with a section of a spacer frame disposed therebetween, and retain the latter. By pivoting the gripper 13, the spacer frame can then be swung by 90°.

Figure 4:
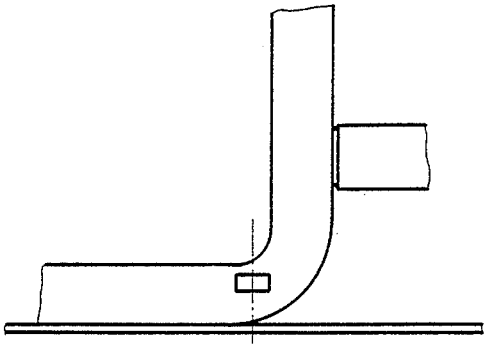
FIGS. 4–7 show various phases during the coating of a corner of a spacer frame.
Figure 5:
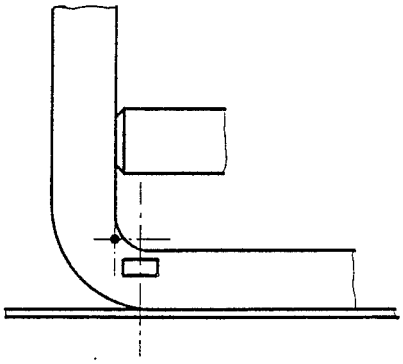
Figure 6:
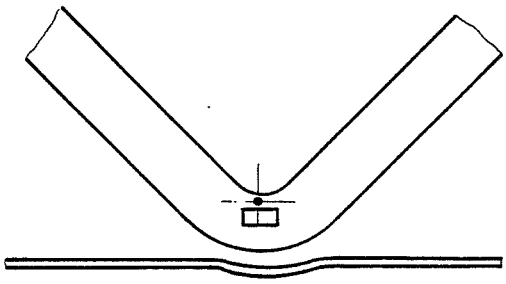
Figure 7:
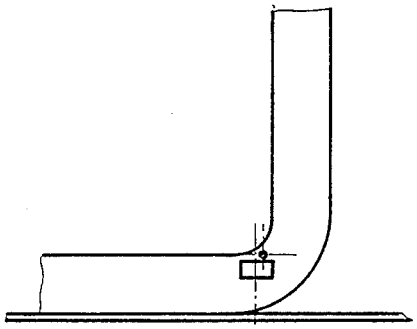

The coating of spacer frames takes place as follows:

A spacer frame is placed manually or by a suitable feeding means on the segment of conveyor belt 11 lying on the left-hand side in FIG. 1, and is placed into contact with the supporting rolls 8. The conveyor belt 11 and the supporting rolls 8, driven at the same peripheral speed, convey the spacer frame toward the right until its end which is at the front as seen in the travel direction passes in between the nozzles 10 where it is initially retained by the reciprocatable stop 28 (FIG. 4). After a quite brief period of time following the onset of extrusion of adhesive and/or sealing compound from the nozzles 10, the stop is retracted and the spacer frame, urged by the contact pressure rollers 12 against the conveyor belt 11, is moved on, the spacer frame section lying on the conveyor belt 11 being coated. As soon as the vertical leg of the spacer frame that is at the rear as seen in the travel direction has passed on to the nozzles 10, the spacer frame is retained by the stop 28 that, in the meantime, has again been advanced (FIG. 5). At this point, by operating the pressure medium motors 23, the clamping jaws 17 of the two clamps 16 of gripper 13 are closed and seize the section resting on the conveyor belt 11 as well as the section of the spacer frame projecting upwardly above the nozzles 10. As soon as this has taken place, the frame 7, by operating the pressure medium motor 6, is tilted rearwardly with the supporting rolls 8 until the spacer frames are no longer in contact with the supporting rolls 8 but rather are now held by the gripper 13 alone. At this stage, the gripper 13 and, with it, the spacer frame are pivoted by 90° in the direction of arrow 27 in FIG. 1 so that the subsequent section of spacer frame to be coated rests on the conveyor belt 11 and can be coated, after releasing the clamps 16 as well as upon forward tilting of the supporting rolls 8 (FIGS. 6 and 7). During this coating step, the gripper 13 is again swung back into its starting position illustrated in FIG. 1.

The just-described processes are repeated until all sections of a rectangular or square spacer frame have been coated.

It is understood that all described activities and movements of the apparatus according to this invention can also be controlled automatically with the use of proximity switches associated with the conveying route. This also holds true for the adjustment of the pivoting speed of the gripper 13, this speed being chosen as mentioned above in dependence on the size of the spacer frame.

Instead of tilting the supporting rolls 8 toward the rear during the turning of the spacer frames, there is also the possibility of driving the supporting rolls 8 in the opposite direction so that, during rotating of the spacer frames, there will be no shear forces occurring between the supporting rolls 8 and the adhesive or sealing compound applied to the spacer frames, which forces would cause damage to the coating. In this arrangement, the mechanical means for tilting of the array of supporting rolls can be omitted.

For purposes of lateral support, it is also possible to employ a rigid supporting wall wherein a transport belt is provided at a spacing above the conveyor belt 11. This transport belt is moved in front of the supporting wall during coating and during the feeding and discharging of the spacer frames and is driven at the same speed as the conveyor belt 11.

In the apparatus of this invention, either the bearing of the turning device (gripper 13) is arranged to be adjustable laterally (in parallel to the conveying direction) and the nozzle block carrying the nozzles 10 is arranged in the machine frame to be vertically adjustable; or the bearing of the turning device is adjustable toward the side as well as vertically. For lateral and, respectively, vertical adjustment, servomotors and/or pressure medium cylinders can be utilized. Owing to this adjustability of the turning gripper and/or of the nozzles, the position of the swivel axis of the gripper 13 with respect to the position of the connecting line of the nozzle orifices can be varied. This relative adjustability permits movement of the nozzles 10 and/or of the spacer frames so that the nozzle orifices are always in opposition to the lateral faces of the spacer frame to be coated, i.e. even in the zone of the bent corners and also during the turning procedure. This is schematically illustrated in FIGS. 4 through 7. Accordingly, the spacer frame can also be coated in the corner zone with adhesive and, respectively, sealing compound.

For purposes of coating in the zone of the bent frame corners, it is adequate to open the valves controlling the feeding of adhesive or sealing compound to the nozzles 10 for a short period of time so that a small amount of adhesive or sealing compound is applied in the corner zone.

Since the adhesive or sealing compound may in certain cases protrude past the outer surface of the spacer frame, undesirable air occlusions can result after compressing the insulating glass pane and sealing the marginal joints with sealing compound (e.g. "Thiokol"). Therefore, one (or several) rollers can be provided associated with the corner zones (or at least one corner zone) of the spacer frames, these rollers pressing the adhesive and sealing compound radially inwardly in the corner region. These rollers are, for example, weighted and automatically follow the contour of the spacer frame in the corner zone. If spacer frames are used having outsides different from planar (for example, so-called space-saving profiles), then either respectively two equiaxial rollers are provided associated with the coatings applied on both sides of the spacer frame, or the roller is profiled in correspondence with the outside of the profiled strip constituting the spacer frame. In order to detect the shape (curvature) of the bent corners, a sensor, preferably an optical fiber sensor, is provided which is operatively connected with the control of the drive mechanisms for the lateral and, respectively, vertical adjustment of the turning device and/or of the nozzles so that such drive mechanism(s) is or are controlled in such a way that the nozzles follow the lateral faces of the spacer frame in the corner zone also during the turning procedure.

The stop 28 for arresting the spacer frames, mentioned above, can be advanced into a second position wherein it brings the spacer frame to a standstill when the end of the linear section (the forward or rearward end) of a leg of the spacer frame is located between the nozzles 10.

I claim:

1. Apparatus for coating spacer frames for insulating glass, said spacer frames having corners and being bent from one piece, said apparatus comprising means for conveying said spacer frames along a conveying path, nozzles arranged on opposite sides of said path for the application of a coating compound to lateral faces of the spacer frames, a lateral support for the spacer frames above said conveying means, a turning device for rotating the spacer frames about an axis extending transversely to a plane of the spacer frames, and means for changing the position of said nozzles relative to said axis.

2. Apparatus as claimed in claim 1, the last named means comprising means for moving said nozzles vertically.

3. Apparatus as claimed in claim 1, the last named means comprising means for mounting said turning device for vertical movement.

4. Apparatus as claimed in claim 3, the last named means comprising also means for moving said nozzles vertically.

5. Apparatus according to claim 1, and sensors that detect the shape of the bent corners of the spacer frame and control the last-named means in such a way that the nozzles are juxtaposed to lateral surfaces of the spacer frames even during turning of the spacer frames.

6. Apparatus as claimed in claim 1, and valves for controlling flow of said compound to the nozzles, said valves being open during the turning of the frames.

7. Apparatus as claimed in claim 1, and at least one roller that presses radially inwardly any said compound that may protrude past an outer surface of a said frame in the region of a frame corner.

8. Apparatus as claimed in claim 7, in which said roller has a profile corresponding to the shape of an outer surface of the spacer frame.

9. Apparatus according to claim 7, there being two equiaxial said rollers each associated with a different side of the spacer frame.

10. Apparatus according to claim 1, and a stop for temporarily retaining a said spacer frame so that a leg of the spacer frame is disposed between said nozzles.

* * * * *